US005916128A

United States Patent [19]

Garr et al.

[11] Patent Number: 5,916,128

[45] Date of Patent: Jun. 29, 1999

[54] SOUND DEADENING AND CATALYST TREATING SYSTEM

[75] Inventors: Gregory Thomas Garr; Martin Robert Jenkins, both of Rochester Hills; Alan Michael Statetzny, Royal Oak, all of Mich.

[73] Assignee: Degussa Corporation, Ridgefield Park, N.J.

[21] Appl. No.: 08/804,515

[22] Filed: Feb. 21, 1997

[51] Int. Cl.[6] ..... F01N 3/00

[52] U.S. Cl. ..... 60/274; 60/299

[58] Field of Search ..... 60/274, 299, 302, 60/308

[56] References Cited

U.S. PATENT DOCUMENTS

| | | | |
|---|---|---|---|
| 4,628,689 | 12/1986 | Jourdan | 60/295 |
| 5,016,438 | 5/1991 | Harris | 60/299 |
| 5,043,147 | 8/1991 | Knight | 60/302 |
| 5,218,817 | 6/1993 | Urata | 60/274 |
| 5,373,119 | 12/1994 | Suzuki et al. | 181/230 |
| 5,457,290 | 10/1995 | Sase et al. | 60/299 |
| 5,578,277 | 11/1996 | White et al. | 60/299 |
| 5,611,198 | 3/1997 | Lane et al. | 60/299 |

FOREIGN PATENT DOCUMENTS

| | | | |
|---|---|---|---|
| 0530493 A2 | 3/1993 | European Pat. Off. . | |
| 0542124A1 | 5/1993 | European Pat. Off. . | |
| 8912193 | 11/1989 | Germany . | |
| 6-108835 | 4/1994 | Japan | 60/299 |
| 1212621 | 11/1970 | United Kingdom . | |
| 97/01023 | 1/1997 | WIPO . | |

*Primary Examiner*—Thomas E. Denion

*Attorney, Agent, or Firm*—Smith, Gambrell & Russell; Beveridge, DeGrandi, Weilacher & Young Intellectual Property Group

[57] ABSTRACT

A canister, especially for two-cycle engines, having both noise reduction and pollutant treatment attributes in a single unit. To effectuate sound reduction the canister muffler has mounted within it several tubes randomly arranged in relation to one another. Thus, an emission stream is forced to frequently change directions, causing a baffling effect and a reduction in noise. Further, these tubes are coated with a catalytic substance to treat the emission stream and thus decrease undesired pollutants. The turbulent flow of the emission stream caused by the tubes also serves to increase the contact with the catalyst. Hence, a single canister is all that is necessary to both silence and treat the emission exhaust stream.

18 Claims, 1 Drawing Sheet

SOUND DEADENING AND CATALYST TREATING SYSTEM

BACKGROUND OF THE INVENTION

Vehicles of a wide variety, including automobiles, personal trucks, motorcycles and motor bikes have quickly become the world's most popular form of daily transportation and today are both manufactured and sold at ever increasing rates. The popularity of the personal vehicle is directly related to its propulsion system, the internal combustion engine, which yields relatively efficient and inexpensive power. Harnessing and manipulating this power, however, does not come without any detrimental effects. The result of each power producing explosion occurring within the internal combustion engine is exhaust, which includes a significant combination of both noise and air pollution. Efforts to eliminate or minimize the after combustion polluting effects of internal combustion engines have become as important today as those efforts which seek to maximize the output force these engines produce.

Two separate units, a muffler and a catalytic converter, are conventionally employed on today's automobiles to minimize emission noise and air pollution, respectively, at two separate stages of the exhaust stream. Mufflers typically are designed in one of three ways: (a) with staggered baffles; (b) with sound defeating angling; or (c) with fiberglass packing. Staggered baffled mufflers are the most commonly used in the automobile industry because they are efficient, inexpensive and easy to manufacture.

Catalytic converters, on the other hand, are typically designed in two ways: (a) with a honeycomb material; or (b) with beads. Both the honeycomb material and the beads are coated with a catalytic substance which causes the undesirable and harmful compounds in the exhaust gas emission stream to be converted in a predetermined catalytic reaction into harmless components.

Hence, treatment of noise and air pollution within an exhaust gas emission stream is accomplished conventionally by these two separate devices, each acting independently of one another. Accordingly, the conventional catalytic converter does not substantially silence exhausting emissions and the conventional muffler does not catalytically treat exhausting emissions.

The need to simultaneously reduce both noise and polluting emissions is of particular importance to manufacturers of small internal combustion engines, such as those for tractors, lawn and yard maintenance equipment, motor bikes, scooters, snow and leaf blowers and other power equipment where there is an increasing demand for reducing emissions and noise levels Most of such small engines are equipped with a small muffler to control noise levels. Since existing small engine manufacturers do not wish to change muffler design, a typical design for such a unit is to include a small metal substrate catalyst for controlling harmful emissions in the existing muffler. In that case, the muffler and catalyst are not independent of each other.

SUMMARY OF THE INVENTION

The present invention relates to an apparatus for an internal combustion engine, particularly a small engine of that type and especially a two-cycle engine, which is capable of both reducing exhaust noise and catalytically controlling pollutant emissions simultaneously and in a single unit. More specifically, this invention relates to a canister which employs at least one perforated and catalytically coated device to simultaneously reduce noise and harmful emissions associated with the exhausting emission stream from gas or diesel engines.

The present invention preferably employs several catalytically coated hollow members situated in a muffler catnister to interrupt the parallel flow of the entering exhaust gas stream, thereby forcing a reduced velocity and deadening the decibel level. In a preferred embodiment of the present invention, the hollow members are tubes; i.e., hollow right cylinders that can be circular or oval in cross-section. The cross-sectional configuration can however, be of any convenient shape. The tubes preferably are fabricated from a metal, but also can be fabricated from a non-metal, such as a ceramic, by conventional manufacturing techniques.

The catalytic coating on the surface of these tubes provides the catalyst interaction necessary to reduce the pollutant content of the emission stream. Any type of known catalytic coating suitable for conversion of the harmful compounds in exhaust streams can be used for this purpose. Examples of such catalysts are widely known; see, for example, Domesle et al., U.S. Pat. No. 5,496,788 and U.S. Pat. No. 5,516,494 of Degussa AG. The tubes can be randomly arranged or according to a regular pattern. Thus, emission noise and pollution are both treated within the same unit and by the same device, thereby obviating the need for two different types of devices.

The tubes are preferably situated in a random manner within the canister to additionally foster non-parallel and turbulent exhaust flow. This type of exhaust flow both effectuates sound deadening effects and promotes catalyst/emission interaction.

Thus, one feature of the invention is an apparatus for catalytic treatment and noise reduction of an exhaust gas emission stream from an internal combustion engine for a vehicle, comprising a canister having an inlet and an outlet and a plurality of hollow elements having an emissions catalyst coated thereon disposed inside the canister. The hollow elements are arranged inside the canister to obstruct a substantially laminar flow of the exhaust gas emission stream entering the inlet of the canister and to produce a turbulent flow and a pressure drop across the inlet and the outlet of the canister, thereby muffling noise from the exhaust gas emission stream before exiting the outlet of the canister. Further, contact between the exhaust gas emission stream and the emissions catalyst causes a catalytic reaction therebetween, thereby catalytically treating the exhaust gas emission stream before exiting the outlet of the canister.

Another feature of the invention is a method for catalytic treatment and noise reduction of an exhaust gas emission stream from an internal combustion engine for a vehicle. This method comprises passing the exhaust gas emission stream into a canister having an inlet and an outlet and having disposed inside a plurality of hollow elements having an emissions catalyst coated thereon. The hollow elements are arranged inside the canister to obstruct a substantially laminar flow of the exhaust gas emission stream entering into the inlet of the canister and passing through the elements, thereby producing turbulent exhaust gas emission stream flow and a drop in pressure across the canister to muffle noise. The method further comprises the step of simultaneously contacting the exhaust gas emission stream with the emissions catalyst under conditions of turbulent flow to thereby cause a catalytic reaction therebetween, thus purifying the exhaust gas emission stream before exiting the outlet of the canister.

BRIEF DESCRIPTION OF THE DRAWINGS

The present invention will be further understood with reference to the drawings, wherein.

DETAILED DESCRIPTION OF THE DRAWINGS

Figure 1:
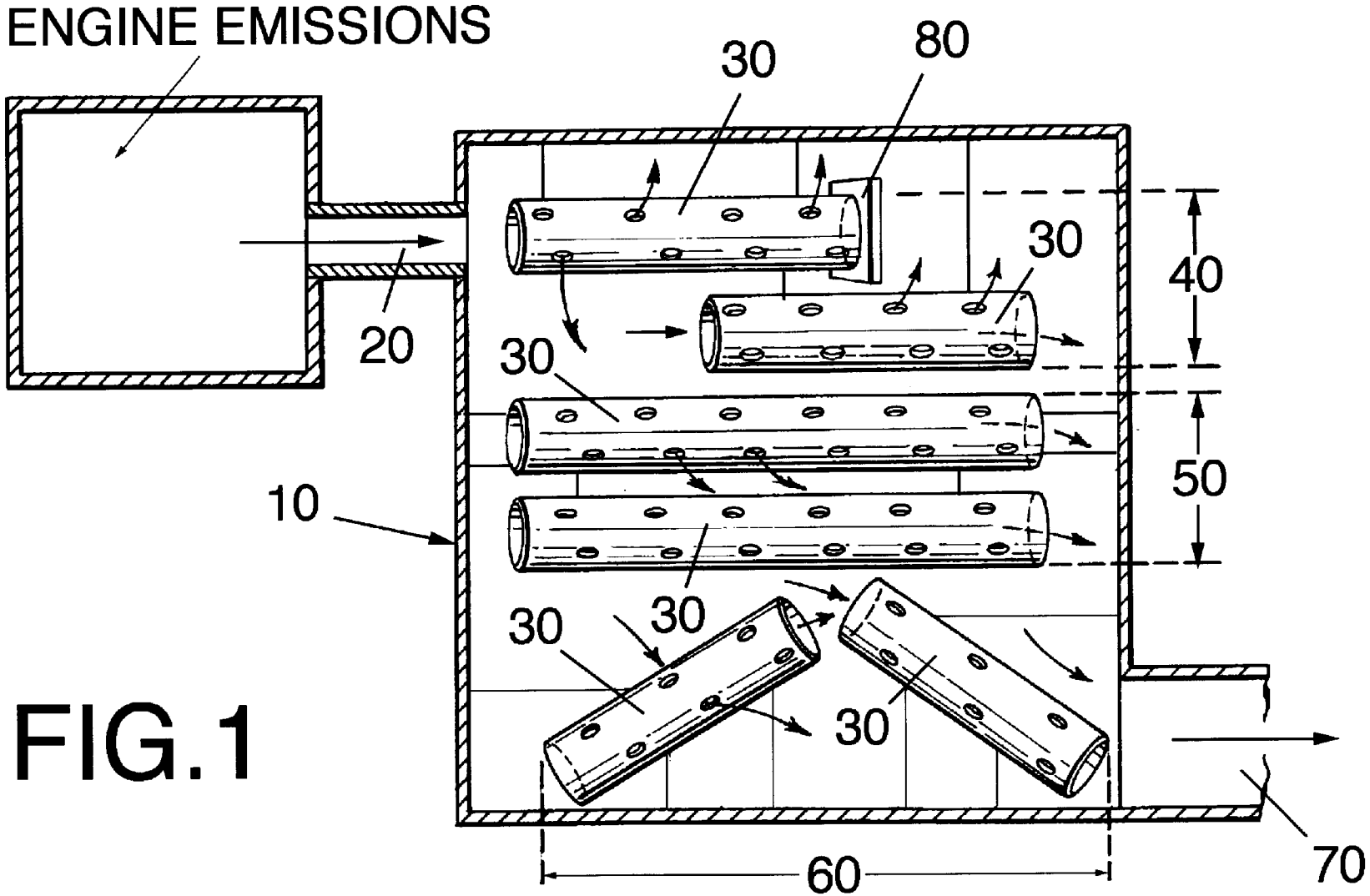
FIG. 1 is a schematic view illustrating the internal arrangement of several tubular devices within a noise muffling and catalytically treating canister unit.

Referring to FIG. 1, a preferred embodiment of the present invention is illustrated. As the combustion process within an engine occurs, the exhaust gas emission stream is directed into the inlet pipe 20 and thereafter, into the muffler canister 10. The inlet pipe 20 and the outlet pipe 70 can be in-line or, as shown in FIG. 1, can be offset. Inside the muffler canister 10, the flow of the exhaust gas emissions stream (represented by arrows in FIG. 1) is forced to change directions frequently due to the plurality of tubes 30 mounted in the muffler canister 10. As illustrated, tube 30 is a hollow right cylinder; i.e. circular in cross-section. The tube is formed of a cylindrical wall and preferably has a series of perforation 35 formed therethrough. These tubes 30 force the exhaust gas emission stream to experience turbulent flow and thus produce a silencing effect. The arrangement of the tubes 30 within the canister can include staggered, aligned or angled orientations, as well as any combination thereof. FIG. 1 illustrates the tubes 30 in an orientation that combines staggered 40, aligned 50 and angled 60 pairs of tubes 30.

In addition to being used to baffle the emission stream flow, the tubes 30 within the muffler canister 10 also treat the exhaust gas emission stream for pollutants. To accomplish this task, the tubes 30 are coated on their surfaces, inside and/or outside, with any suitable catalyst well known and/or conventionally used in automobile emissions treatment to, for example, catalytically convert pollutant exhaust gases into carbon dioxide and water. Thus, the interaction between the emissions stream and the tubes 30 both lower the pollutant content of the emission stream, due to the catalyst coating on the tubes 30, and at the same time lower the noise level, due to the turbulent flow and the pressure drop across the canister 10 produced by the tubes 30.

The perforations 35 along the periphery of the tubes 30 help create turbulent flow streams within the muffler 10 and enhance the interaction between the emission stream and the catalytic coating.

After contacting the tubes 30 within the muffler canister 10, the exhaust, being treated and silenced, exits the muffler canister 10 through the exhaust outlet pipe 70.

The multiplicity, specific arrangement and dimensions of the tubes within the muffler all preferably are random to further promote turbulent flow, and are variable depending on the desired use, the desired degree of noise attenuation/pollution treatment and the type and size of the engine.

In a preferred variation, the tubes are perforated in any convenient shape in a random or regular pattern to further promote turbulent flow within the muffler canister. Thus, the exhaust gas enters the tube element and at least a portion of the gas stream exits from the perforations in the tube wall to thereby increase turbulent flow. A baffle plate 80 can be adapted to one end of a tube 30 to increase exhaust stream flow through the perforations. The dimensions and the arrangement of the perforations on each tube also preferably are random and are variable according to the above factors.

Thus, a muffler canister in accordance with the present invention employs tubes of equal or unequal diameter oriented in a staggered, an aligned and/or an angled relation (from 45° to 180° relative to one another), and each individual tube has similar or differing perforation patterns.

The tubes are secured within the noise muffler by welding the tubes to the muffler canister and/or by welding the tubes 10 to each other, by packing the tubes within an enclosed canister, or by any conventional method known to those of ordinary skill in the art.

In a preferred canister arrangement, tubes having a height and length equal to the inner dimensions of the canister are packed and sealed therein. Such an arrangement provides a compact aligned, end-to-end orientation of the tubes. This forces exhaust through the tubes rather then around them, influencing both catalytic interaction and the necessary baffling effect. The canister itself can be formed of any convenient metal and can be circular, rectangular or any other shape in cross-section. Typical canister designs known in the art can be used for purposes of the present invention.

Also, the effects of vibration on the tubes can be reduced by employing a nonflammable material, such as vermiculite or ceramic, on any portion of the inside walls of the canister.

Further, an insulator can be placed on the inside walls to reduce canister heat.

Hence, an apparatus constructed in accordance with the present invention provides the silencing effect of a conventional small engine muffler as well as the pollution treatment aspects of a conventional catalytic converter in a single unit.

It is to be understood that the embodiment described herein merely represents a preferred embodiment of the present invention. Variations and modifications of the invention as herein described will be apparent to those skilled in the art, including a change in the multiplicity of tubes or the use of non-tubular elements, and are intended to be encompassed by the claims appended hereto.

We claim:

1. An apparatus for catalytic treatment and noise reduction of an exhaust gas emission stream from an internal combustion engine, comprising:

a canister having an inlet and an outlet; and a plurality of hollow elements having a plurality of perforations therein and an emissions catalyst coated thereon disposed inside said canister, wherein, said hollow elements are arranged to obstruct a substantially laminar flow of said exhaust gas emission stream entering said inlet of said canister and to produce a turbulent flow and a pressure drop across said inlet and said outlet of said canister, thereby muffling noise from said exhaust gas emission stream before exiting said outlet of said canister, and contact between said exhaust gas emission stream and said emission catalyst causes a catalytic reaction therebetween, thereby catalytically treating said exhaust gas emission stream before exiting said outlet of said canister.

2. The apparatus for catalytic treatment and noise reduction of an exhaust gas emission stream as defined in claim 1, wherein:

said hollow elements comprise tubes.

3. The apparatus for catalytic treatment and noise reduction of an exhaust gas emission stream as defined in claim 2, wherein:

said tubes are arranged in an aligned relation.

4. The apparatus for catalytic treatment and noise reduction of an exhaust gas emission stream as defined in claim 2, wherein:

said tubes are arranged in an staggered relation.

5. The apparatus for catalytic treatment and noise reduction of an exhaust gas emission stream as defined in claim 2, wherein:

said tubes are arranged in an angled relation.

6. The apparatus for catalytic treatment and noise reduction of an exhaust gas emission stream as defined in claim 3, wherein:

said tubes are arranged in an aligned relation.

7. The apparatus for catalytic treatment and noise reduction of an exhaust gas emission stream as defined in claim 2, wherein:

said tubes are arranged in an staggered relation.

8. The apparatus for catalytic treatment and noise reduction of an exhaust gas emission stream as defined in claim 2, wherein:

said tubes are arranged in an angled relation.

9. The apparatus for catalytic treatment and noise reduction of an exhaust gas emission stream as defined in claim 1, wherein:

said inlet and said outlet of said canister are in line.

10. The apparatus for catalytic treatment and noise reduction of an exhaust gas emission stream as defined in claim 1, wherein:

said inlet and said outlet of said canister are offset.

11. An apparatus for catalytic treatment and noise reduction of an exhaust gas emission stream from an internal combustion engine, comprising:

a canister having an inlet and an outlet; and at least one hollow element having a plurality of perforations therein and an emissions catalyst coated thereon disposed inside said canister, wherein, said hollow element is arranged to obstruct a substantially laminar flow of said exhaust gas emission stream entering said inlet of said canister and to produce a turbulent flow and a pressure drop across said inlet and said outlet of said canister, thereby muffling noise from said exhaust gas emission stream before exiting said outlet of said canister, and contact between said exhaust gas emission stream and said emissions catalyst causes a catalytic reaction therebetween, thereby catalytically treating said exhaust gas emission stream before exiting said outlet of said canister.

12. The apparatus for catalytic treatment and noise reduction of an exhaust gas emission stream as defined in claim 11, wherein:

said hollow element comprises a tube.

13. The apparatus for catalytic treatment and noise reduction of an exhaust gas emission stream as defined in claim 13, further comprising:

a baffle plate member engaged at one end of said hollow element.

14. An exhaust system for an internal combustion engine having an exhaust manifold, comprising:

a first pipe connected to said exhaust manifold and receiving an exhaust gas emission stream therefrom;

a noise muffling and catalytically treating canister connected to said first pipe and receiving said exhaust gas emission stream therefrom said canister including an inlet and an outlet and a plurality of hollow elements disposed therein, said hollow elements having an emissions catalyst coated thereon; and a second pipe for exhausting said exhaust gas emission stream, said second pipe being connected to said canister and receiving said exhaust gas emission stream therefrom, wherein, said hollow elements disposed in said canister are arranged to obstruct a substantially laminar flow of said exhaust gas emission stream entering said inlet and to produce a turbulent flow inside the hollow elements and a pressure drop across said inlet and said outlet of said canister, thereby muffling noise from said exhaust gas emissions stream before exiting said outlet of said canister, and contact between said exhaust gas emission stream and said emissions catalyst causes a catalytic reaction therebetween, thereby catalytically treating said exhaust gas emission stream before exiting said outlet of said canister.

15. The exhaust system according to claim 14 wherein:

said canister is the sole means in said exhaust system for muffling noise and catalytically treating said exhaust gas emission stream.

16. A method for catalytic treatment and noise reduction of an exhaust gas emission stream from an internal combustion engine, comprising:

passing said exhaust gas emission stream into a canister having an inlet and an outlet, said canister containing a plurality of hollow elements having a plurality of perforations therein and an emissions catalyst coated thereon, wherein said hollow elements are arranged to obstruct a substantially laminar flow of said exhaust gas emission stream entering said inlet of said canister and passing through said elements thereby producing a turbulent flow of said exhaust gas emission stream and a pressure drop across said inlet and said outlet of said canister, thereby muffling noise from said exhaust gas emission stream before exiting said outlet of said canister, and simultaneously contacting said exhaust gas emission stream with said emissions catalyst under conditions of turbulent flow to thereby cause a catalytic reaction therebetween, thereby catalytically treating said exhaust gas emission stream before exiting said outlet of said canister.

17. The method for catalytic treatment and noise reduction as defined in claim 16, wherein:

said hollow elements are tubes and said exhaust gas emission stream passes through said hollow elements and at least some of said stream passes through said perforations to thereby increase turbulent flow of said stream.

18. The exhaust system according to claim 15 wherein:

pollutant content and volume level of said exhaust gas emission stream exiting said second pipe are in compliance with applicable federal regulations.

* * * * *